US009949326B2

(12) United States Patent
Elo et al.

(10) Patent No.: US 9,949,326 B2
(45) Date of Patent: Apr. 17, 2018

(54) PREDICTIVE LED FORWARD VOLTAGE FOR A PWM CURRENT LOOP

(71) Applicant: TEXAS INSTRUMENTS INCORPORATED, Dallas, TX (US)

(72) Inventors: Peter Mikael Elo, Oulu (FI); Ari Kalevi Väänänen, Oulu (FI)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 15/176,670

(22) Filed: Jun. 8, 2016

(65) Prior Publication Data

US 2017/0359866 A1 Dec. 14, 2017

(51) Int. Cl.
*H05B 37/02* (2006.01)
*H05B 33/08* (2006.01)

(52) U.S. Cl.
CPC ..... *H05B 33/083* (2013.01); *H05B 33/0845* (2013.01)

(58) Field of Classification Search
CPC ..... H05B 33/083; H05B 33/0815; H05B 33/0821
USPC ..... 315/186
See application file for complete search history.

(56) References Cited

U.S. PATENT DOCUMENTS 7,439,945 B1 * 10/2008 Await ..... H05B 33/0818 315/250
2008/0068205 A1 * 3/2008 Witkowski ..... B60R 25/24 340/4.3
2011/0006689 A1 * 1/2011 Blanchard ..... H05B 33/0824 315/121
2011/0273102 A1 * 11/2011 van de Ven ..... H05B 33/0809 315/193
2012/0206042 A1 * 8/2012 Yang ..... H05B 33/083 315/52
2013/0119876 A1 * 5/2013 Shin ..... H05B 33/0827 315/186
2013/0221867 A1 * 8/2013 Deppe ..... H05B 33/0809 315/224
2013/0285564 A1 10/2013 van de Ven et al.
2014/0145634 A1 5/2014 Sullivan et al.
2014/0184076 A1 * 7/2014 Murphy ..... H05B 33/0824 315/121
2014/0210364 A1 * 7/2014 Cash ..... H05B 33/0866 315/186
2014/0361706 A1 12/2014 Kulkarni et al.
2015/0173153 A1 6/2015 Hsiu et al.
(Continued)

FOREIGN PATENT DOCUMENTS

WO WO2008025153 A1 3/2008

OTHER PUBLICATIONS

Search Report for PCT Application No. PCT/US17/36593, dated Sep. 7, 2017 (1 page).

*Primary Examiner* — Don Le
(74) *Attorney, Agent, or Firm* — William B. Kempler; Charles A. Brill; Frank D. Cimino

(57) ABSTRACT

A light system is disclosed. The light system includes a light emitting diode (LED) and a shunt transistor having a current path connected to the LED. A ramp generator circuit generates a ramp voltage. An amplifier has a first input terminal connected to the LED, a second input terminal coupled to receive the ramp voltage, and an output terminal connected to a control terminal of the shunt transistor.

18 Claims, 6 Drawing Sheets

(56) References Cited

U.S. PATENT DOCUMENTS

| | | | | |
|---|---|---|---|---|
| 2015/0189711 | A1* | 7/2015 | Horsky | H05B 33/083 315/186 |
| 2015/0359050 | A1* | 12/2015 | van de Ven | H05B 33/0857 315/294 |
| 2016/0049939 | A1* | 2/2016 | Martin | H03K 19/017545 315/209 R |

* cited by examiner

PREDICTIVE LED FORWARD VOLTAGE FOR A PWM CURRENT LOOP

BACKGROUND OF THE INVENTION

Embodiments of the present invention relate to a circuit and method for a light emitting diode (LED) lighting system with predictive forward voltage for a pulse width modulated (PWM) current loop.

Light emitting diode (LED) lighting systems are presently used for many applications such as automobiles, homes, businesses, and security systems. LED lighting systems provide illumination more efficiently than incandescent lighting systems, since they expend much less power in heat generation and are much more reliable. LED lighting systems are also much more flexible than fluorescent lighting systems, since they are more tolerant to environmental conditions such as shock, contamination, and temperature. Moreover, they may be operated with controlled duty cycles to adjust brightness. LED lighting systems are often configured as series-connected LEDs due to their relatively small forward voltage. As such, the series connection or string of LEDs may produce substantial electromagnetic interference (EMI) due to abrupt changes in the relatively large forward current and high series inductance. The EMI may adversely affect nearby electronic communication systems. Filter circuits and shielding may reduce EMI but compromise system efficiency and increase cost.

The present inventors, therefore, recognize that still further improvements are possible. Accordingly, the preferred embodiments described below are directed toward improving upon LED lighting systems of the prior art.

BRIEF SUMMARY OF THE INVENTION

In one embodiment of the present invention, a light system is disclosed. The light system includes a current source connected to a first end of a plurality of series-connected light emitting diode (LED) modules. A second end of the series-connected LED modules is connected to a supply voltage terminal. Each LED module has a slew rate control circuit to control voltage across the respective module.

In another embodiment of the present invention, a light system is disclosed. The light system includes a light emitting diode (LED) and a shunt transistor having a current path connected to the LED. A ramp generator circuit generates a ramp voltage. An amplifier has a first input terminal connected to the LED, a second input terminal coupled to receive the ramp voltage, and an output terminal connected to a control terminal of the shunt transistor.

DETAILED DESCRIPTION OF THE INVENTION

The preferred embodiments of the present invention provide significant advantages over LED lighting systems of the prior art as will become evident from the following detailed description.

Figure 1:
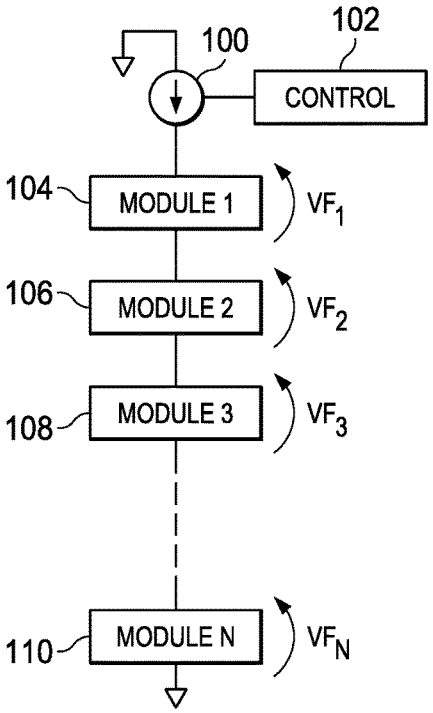
FIG. 1 is a LED lighting system having plural series-connected modules.

Referring to FIG. 1, there is a light emitting diode (LED) lighting system of the present invention which may be used for automotive lighting, home lighting, security lighting, or other applications where efficiency and low electromagnetic interference (EMI) are desirable. The lighting system includes N series-connected modules 104 through 110, where N is a positive integer greater than or equal to one. The series-connected modules are powered by current source 100, which is preferably pulse width modulated (PWM) to control power of the modules and brightness of LEDs associated with the modules. Each series-connected module conducts current from current source 100 to provide a respective forward voltage $VF_1$ through $VF_N$ across the module. Since the LEDs are typically discrete components, however, their current-voltage characteristics may not be closely matched. Thus, each forward voltage may be slightly different from others in the series string of modules. Control circuit 102 controls the duty cycle of PWM current pulses supplied to the series-connected modules. Additionally, control circuit 102 communicates programming signals to each of the modules to control operation. Preferably, these control signals are communicated to the modules over the same single-wire connection that supplies PWM module current by frequency shift keyed (FSK) or amplitude shift keyed (ASK) modulation. The modules may be advantageously controlled as individually addressable modules or collectively controlled as a group or groups of modules.

Figure 2:
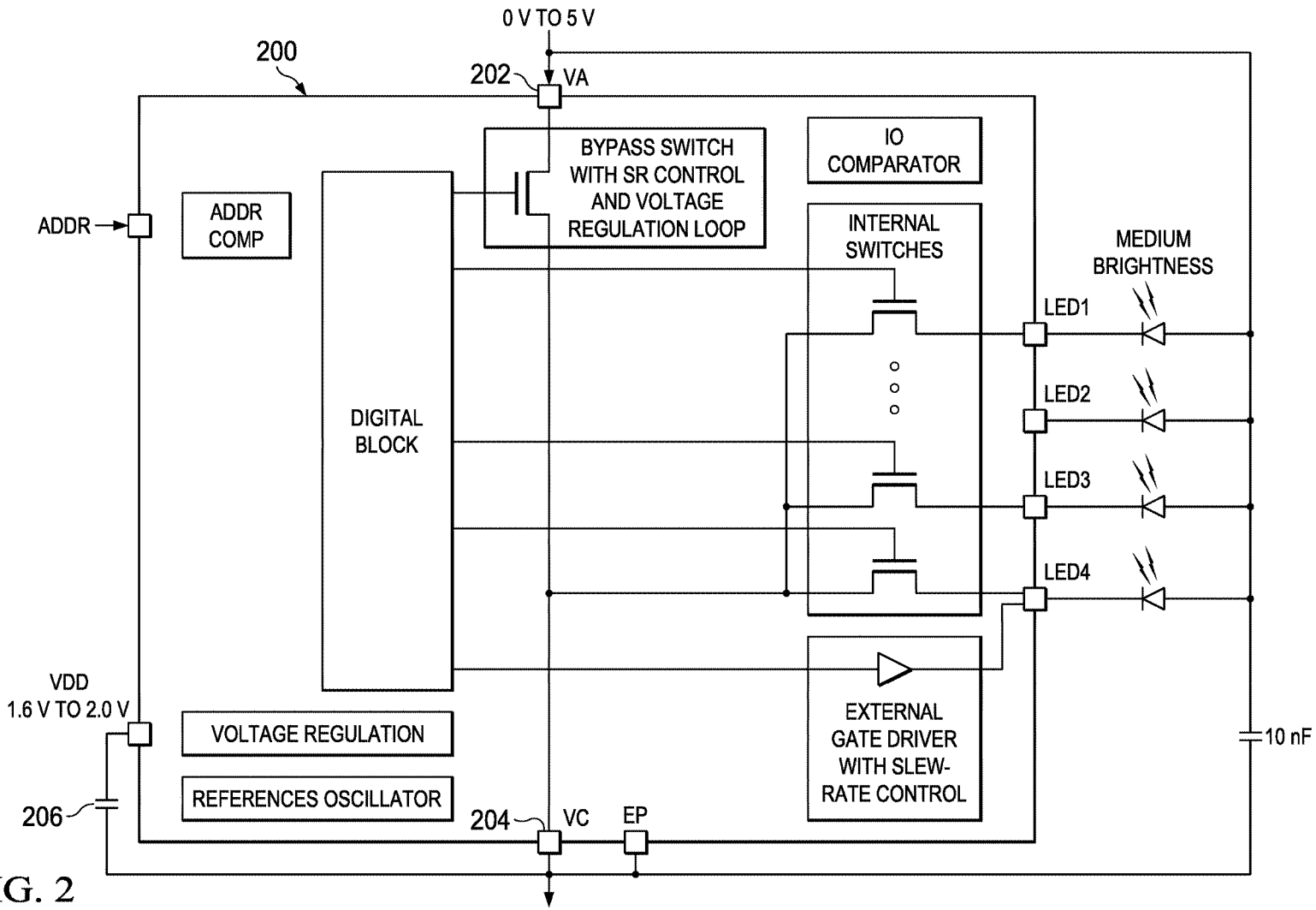
FIG. 2 is a circuit diagram of a LED module control circuit that may be used in the lighting system of FIG. 1.

Turning now to FIG. 2, there is a circuit diagram of a LED module control circuit 200 as may be included in modules 104 through 110 for the lighting system of FIG. 1. The module control circuit is coupled to receive positive current from current source 100 (FIG. 1) at anode terminal 202 either by direct connection or through other series-connected modules. The module control circuit includes four channels corresponding to terminals LED1 through LED4. Terminals LED1 through LED4 correspond to respective blue, green, red, and white LED channels. These are preferably activated by internal switches controlled by the digital block. Alternatively, terminal LED4 may be used for a high current white LED for automotive headlights or security lighting. As such, it may be driven separately by an external gate driver with slew rate control as will be explained in detail. For some applications, therefore, only a single LED channel may be utilized. For other applications, two or more LED channels may be utilized. When an LED is selected by a respective internal switch, current from anode terminal 202 flows through the switch to illuminate the LED and through the cathode terminal 204 to ground or $V_{SS}$. Cathode terminal 204 may be connected to VSS through other series-connected modules or directly connected as with module 110. When no LED associated with the module is selected, positive current is shunted from anode terminal 202 to cathode terminal 204 via a bypass switch with slew rate (SR) control and voltage regulation. For either case, therefore, anode voltage VA at terminal 202 is developed with respect to cathode voltage VC at terminal 204. The difference between the anode and cathode voltage (VA−VC) is the forward voltage VF across the module.

LED module control circuit 200 also includes an input-output (TO) comparator circuit to communicate with control circuit 102 (FIG. 1). An address comparator is coupled to the ADDR terminal to provide a specific module address for applications where modules are individually accessed. A voltage regulation circuit develops and regulates a local $V_{DD}$ supply voltage across capacitor 206 from the module forward voltage VF. Voltage references and local oscillator signals required for module control circuit operation as well as for the digital block are powered by the local $V_{DD}$ supply voltage. Terminal EP is a die attach pad that is used to mount the module for mechanical support and as a heat sink.

Figure 3:
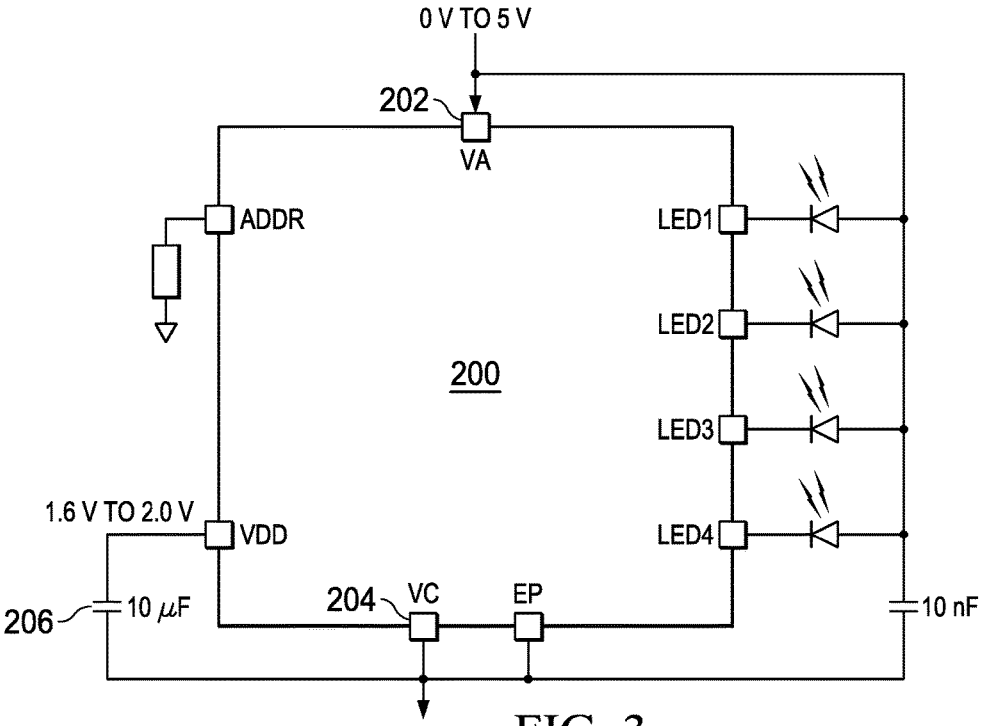
FIG. 3 is circuit diagram showing a LED module control circuit as in FIG. 2 configured to directly drive one or more LEDs.

FIG. 3 is circuit diagram showing a LED module control circuit 200 as in FIG. 2 configured to directly drive a plurality of LEDs. Here and in the following discussion, the same reference numerals are used to identify substantially the same circuit elements. In this embodiment of the present invention, terminals LED1 through LED4 directly drive respective medium to low brightness LEDs. In this case, a 10 nF decoupling capacitor between LED anodes and cathode terminal 204 may be sufficient to attenuate EMI.

Figure 4:
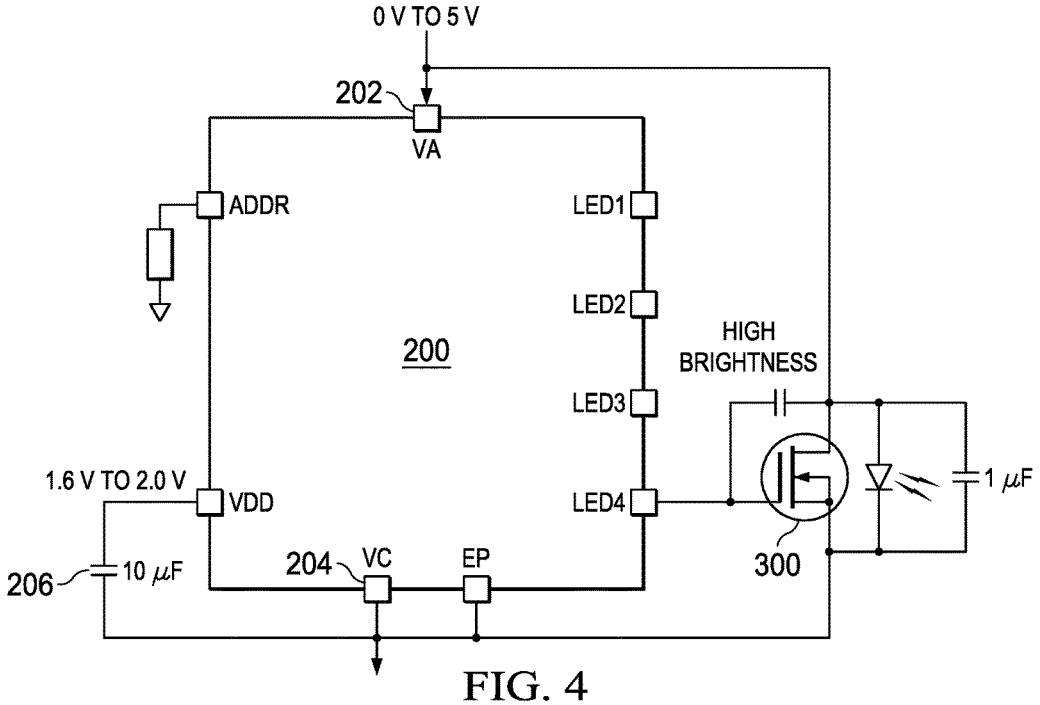
FIG. 4 is a circuit diagram showing a LED module control circuit as in FIG. 2 configured to indirectly drive an LED with an external transistor.

By way of comparison, FIG. 4 is a circuit diagram showing a LED module control circuit 200 as in FIG. 2 configured to indirectly drive one LED with an external transistor 300 for high brightness and high current applications. Here, a 1 μF decoupling capacitor is employed in parallel with the white LED. Shunt transistor 300 is employed in parallel with the LED to shunt module current when the LED is unselected. Shunt transistor 300, therefore, is preferably external to the module and specifically designed for high current applications. Shunt transistor 300 may be an n-channel enhancement mode transistor, a p-channel enhancement mode transistor, a bipolar transistor, a junction field effect transistor (JFET), or other suitable switching device as is known to those of ordinary skill in the art. It is important to note that external components such as LEDs and drive transistors of each module are slightly different, since they are not fabricated on the same integrated circuit. Thus, the forward voltage VF of each module is slightly different.

Figure 5:
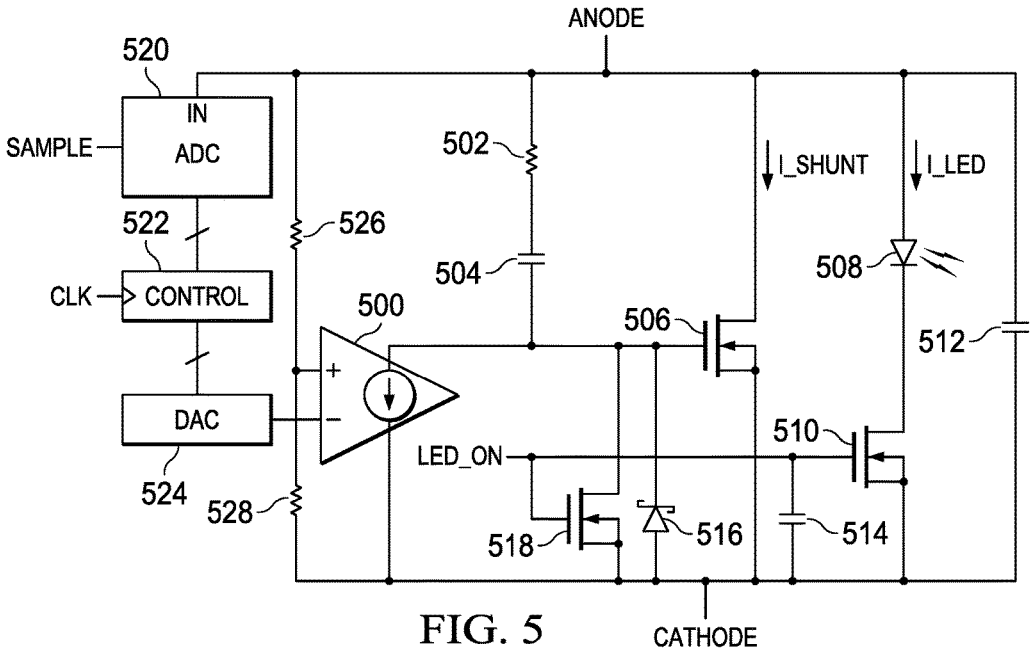
FIG. 5 is a circuit diagram a LED module as in FIG. 1 with slew rate (SR) control.

Referring next to FIG. 5, there is a circuit diagram of a LED module as in FIG. 1 with slew rate control. Some elements of the module control circuit are omitted for clarity. LED 508, n-channel drive transistor 510 and capacitors 512 and 514 may be external to the module control circuit for high current applications. Capacitor 514 serves to filter the gate voltage of n-channel drive transistor 510. N-channel transistor 506 shunts current from the ANODE terminal to the CATHODE terminal when LED 508 is unselected. Therefore, n-channel transistor 506 may also be external to the module control circuit for high current applications. Resistor 502 and capacitor 504 form an amplifier stability compensation network at the gate on transistor 506. Schottky diode 516 is optional and may serve to limit the range of gate voltage at n-channel transistor 506 in some embodiments. N-channel transistor 518 and n-channel drive transistor 510 are coupled to receive control signal LED_ON. A high level of LED_ON turns on n-channel drive transistor 510 to illuminate LED 508. The high level also turns on n-channel transistor 518, thereby turning n-channel shunt transistor 506 off. Alternatively, a low level of control signal LED_ON turns off both n-channel transistor 518 and n-channel drive transistor 510 so that LED 508 is unselected. In this mode the gate voltage of shunt transistor 506 is controlled by amplifier 500. Resistors 526 and 528 form a voltage divider between the ANODE and CATHODE terminals. A positive input terminal of amplifier 500 is coupled to the ANODE terminal by resistor 526. A negative input terminal 500 is coupled to digital-to-analog converter (DAC) 524. Analog-to-digital converter (ADC) 520 is coupled to receive a sample of the ANODE terminal voltage in response to a high level of the SAMPLE signal. Here and in the following discussion, all module voltages are referenced to the local CATHODE terminal. The ANODE terminal voltage VA, therefore, is the difference between ANODE voltage VA and CATHODE voltage VC (VA−VC). The ADC applies a digital sample of the ANODE terminal voltage to slew rate control circuit 522, which applies the digital sample to DAC 524.

Figure 6:
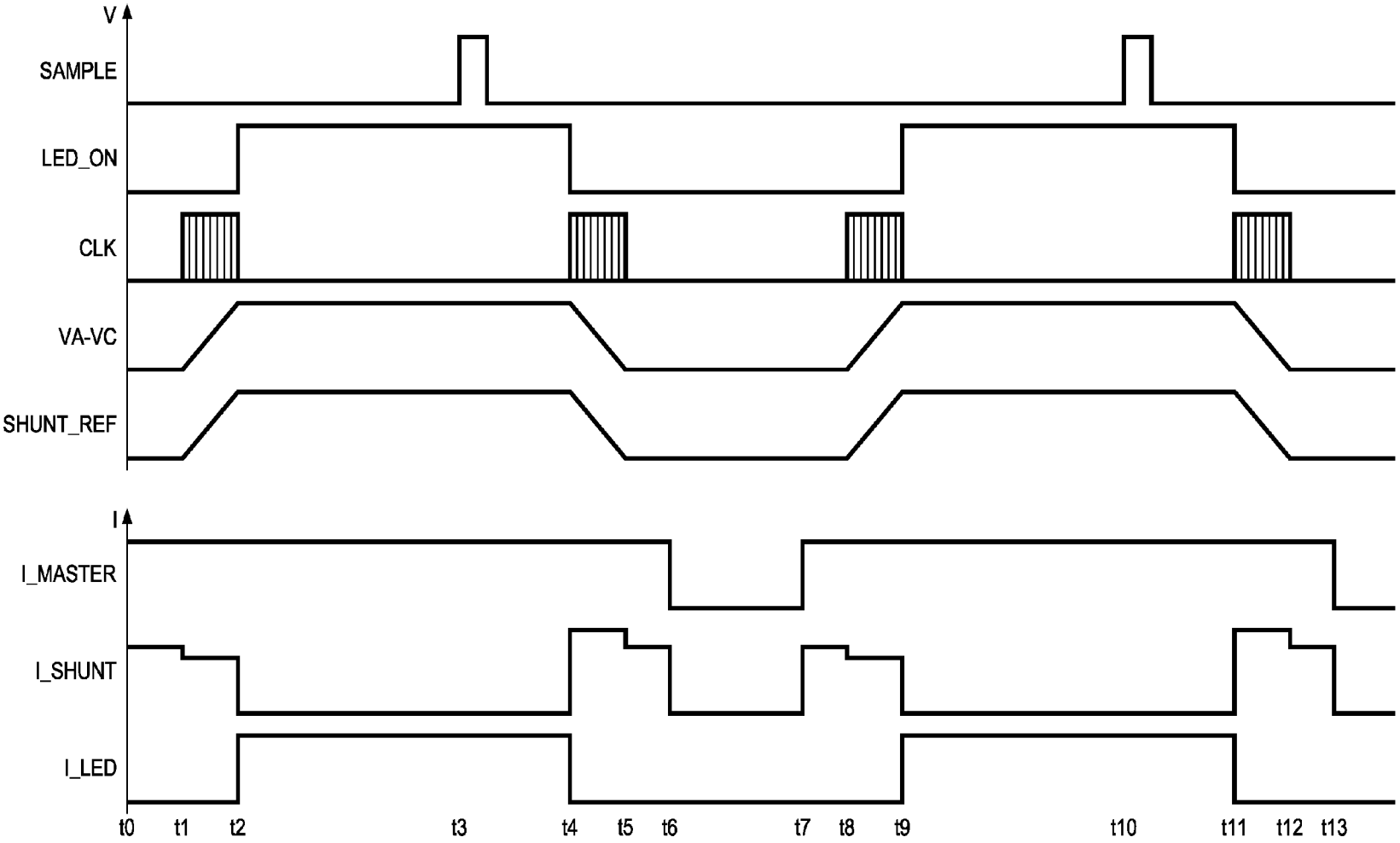
FIG. 6 is a timing diagram showing operation of the circuit of FIG. 5 with a 50% duty cycle.
Figure 7:
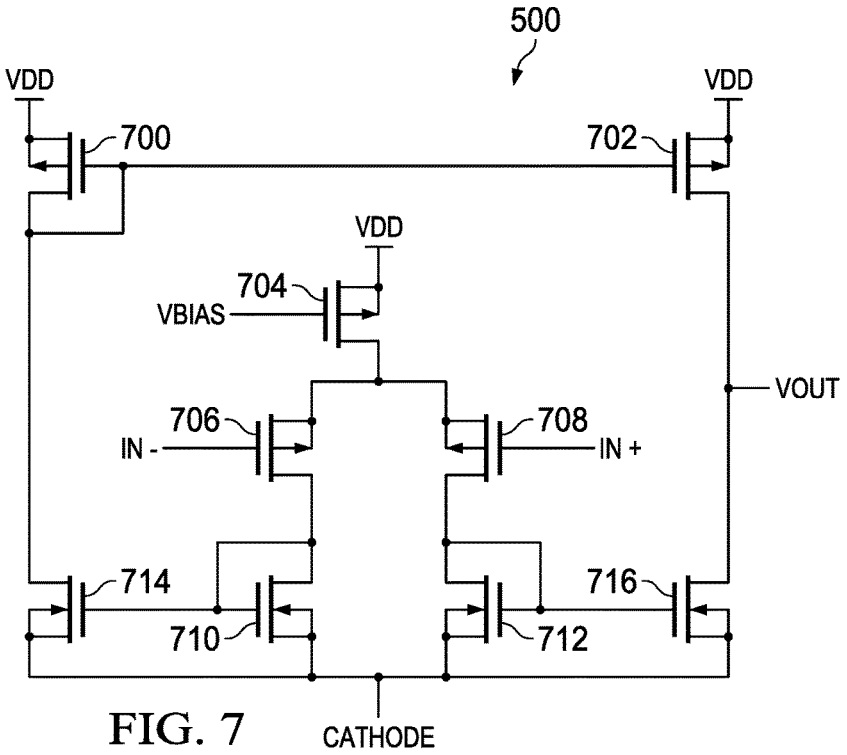
FIG. 7 is a schematic diagram of amplifier 500 of FIG. 5.

Operation of the module control circuit of FIG. 5 will now be explained with reference to the timing diagram of FIG. 6. At time t0, LED 508 is unselected and I_LED is zero. LED_ON is low, so n-channel drive transistor 510 and n-channel transistor 518 are off. In this mode, amplifier 500 controls the gate voltage of n-channel shunt transistor 506. Referring to FIG. 7, there is a schematic diagram of amplifier 500. Supply voltage $V_{DD}$ and bias voltage $V_{BIAS}$ are applied to respective source and gate terminals of p-channel bias transistor 704. P-channel bias transistor 704 provides a bias current to source terminals of p-channel input transistors 706 and 708. The gate terminal of p-channel input transistor 706 is the negative input terminal of amplifier 500 and is connected to DAC 524. The gate terminal of p-channel input transistor 708 is the positive input terminal of amplifier 500 and is connected to resistor 526. Input transistors 706 and 708 divide the bias current from bias transistor 704 according to the input difference voltage. Current through input transistor 706 is conducted through n-channel transistor 710 and mirrored in n-channel transistor 714. Current through input transistor 708 is conducted through n-channel transistor 712 and mirrored in n-channel transistor 716. Current through n-channel transistor 714 is conducted from supply voltage $V_{DD}$ through p-channel transistor 700 and mirrored in p-channel output transistor 702. At time t0, the positive input of amplifier 500 is VA−VC=0. Likewise, the negative input of amplifier 500 is SHUNT_REF=0. Transistor sizes are designed so that at time t0, when both inputs of amplifier 500 are equal, output voltage $V_{OUT}$ is sufficient to turn on shunt transistor 506, so drain current I_SHUNT is equal to current I_MASTER 100.

Figure 8:
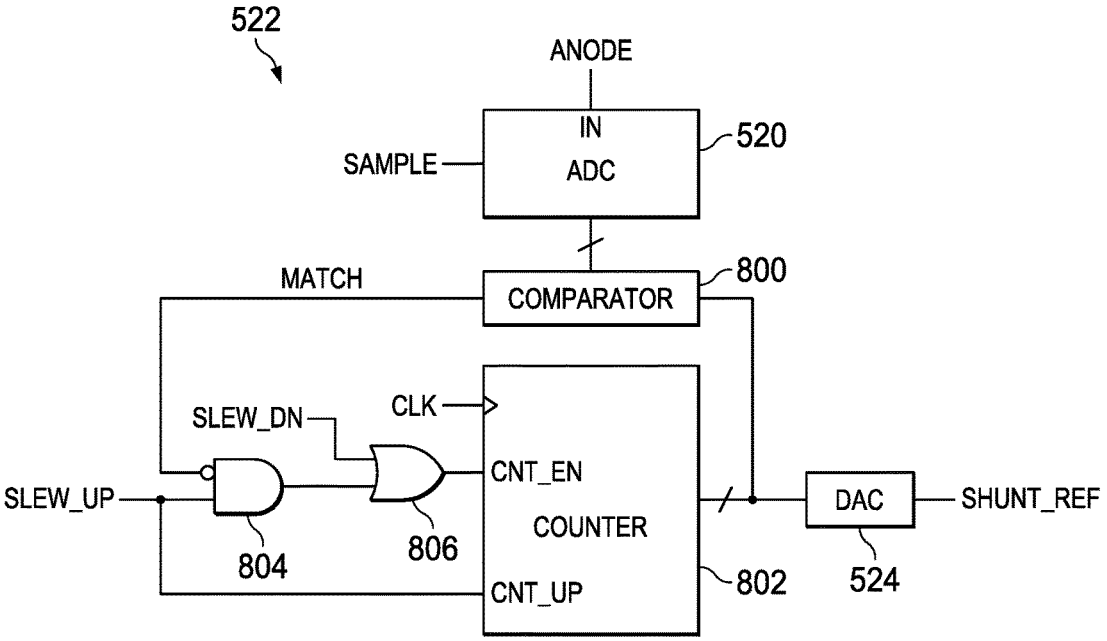
FIG. 8 is a circuit diagram of the slew rate control circuit of FIG. 5.
Figure 9:
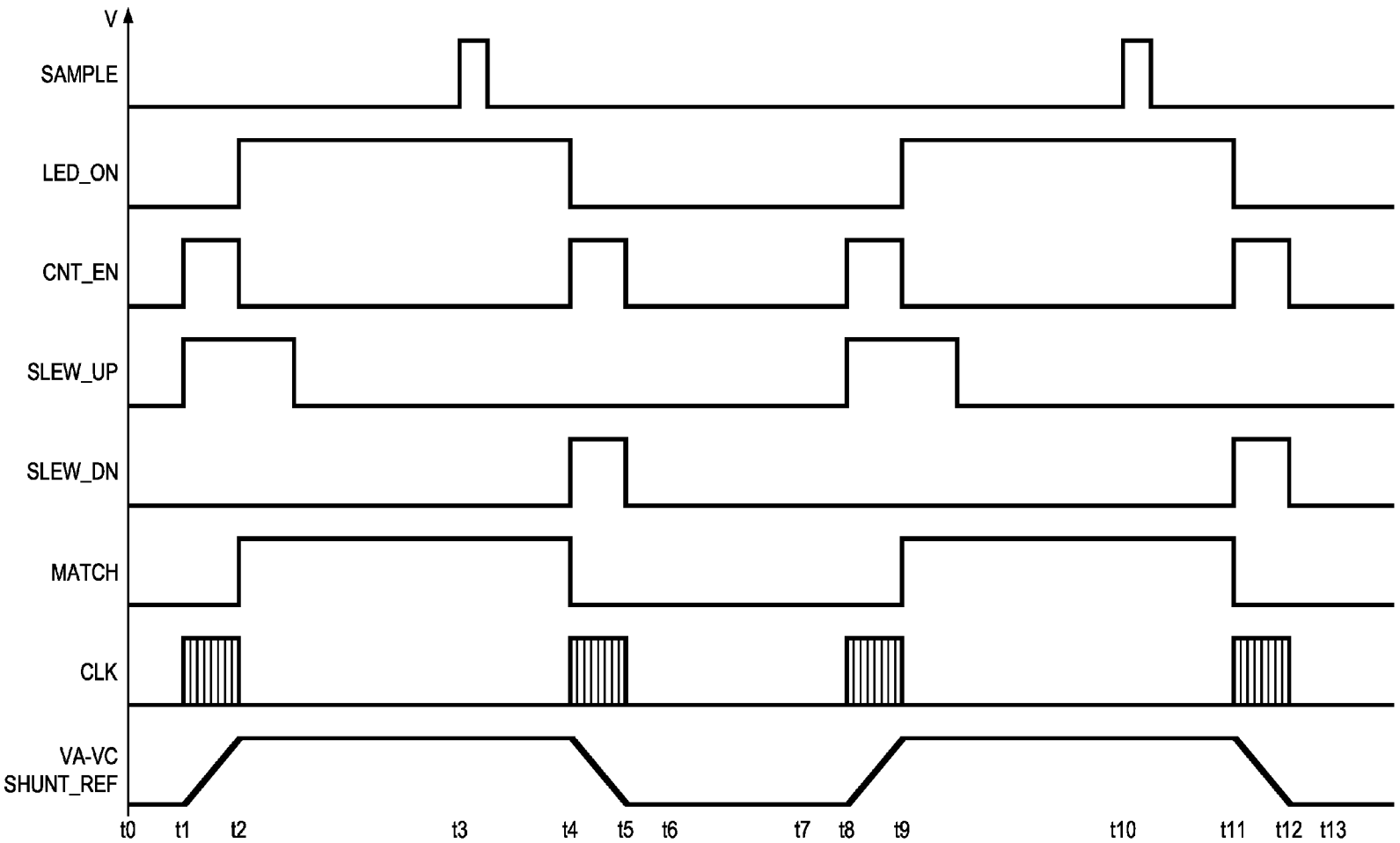
FIG. 9 is a timing diagram showing operation of the slew rate control circuit of FIG. 8.

Referring now to FIGS. 8 and 9, operation of slew rate control circuit 522 will be explained. The slew rate control circuit includes digital comparator 800 and up/down counter 802. ADC circuit 520 applies a digital sample of ANODE terminal voltage VA from a previous cycle to one set of inputs of comparator 800. Counter 802 applies a present count from counter 802 to another set of inputs of comparator 800. The initial count of counter 802 does not match the digital sample of ANODE voltage VA, so MATCH is initially low. At time t1, a high level of SLEW_UP initiates a positive slew rate transition of SHUNT_REF, and clock signal CLK begins to oscillate. The high level of SLEW_UP and the low level of MATCH produce a high level output from AND gate 804 and from OR gate 806. The high level from OR gate 806 is applied to the count enable (CNT_EN) terminal of counter 802. The high level from SLEW_UP is applied to the CNT_UP terminal of counter 802 causing it to count up in response to clock signal CLK. DAC 524 receives the increasing count and produces a corresponding step-wise linear increase in SHUNT_REF. SHUNT_REF is applied to the negative input terminal of amplifier 500 (FIG. 5). The increase in SHUNT_REF causes a decrease in $V_{OUT}$ from amplifier 500, which is applied to the gate of n-channel transistor 506. This decrease in gate voltage produces a slight decrease in drain current I_SHUNT through n-channel transistor 506 and a corresponding step-wise linear increase in ANODE voltage VA. The increase in VA is due to current from source 100 charging capacitor 512. Thus, VA tracks the incremental increase of SHUNT_REF as indicated by the bold line between times t1 and t2. However, the digital sample of VA from a previous cycle at the output of ADC 520 remains unchanged.

Counter 802 continues to count up from time t1 until time t2. At time t2 both SHUNT_REF and ANODE terminal voltage (VA−VC) have attained a high level through a controlled and step-wise linear slew rate. Also at time t2 the count from counter 802 matches the digital sample from ADC 520. Comparator 800 responsively produces a high level MATCH signal. The high level of MATCH produces a low level output from AND gate 804. Both inputs to OR gate 806 are low and produce a low input at the CNT_EN terminal of counter 802 to disable the counter. SLEW_UP remains high for short time after t2, since it is generally not known when the counter output will equal the ADC sample until MATCH goes high.

When MATCH goes high, ANODE voltage VA−VC is equal to the sampled anode voltage from a previous cycle. Responsively, LED_ON goes high to turn on LED drive transistor 510 and illuminate LED 508. Transistor 518 also turns on at substantially the same time to drive the gate of n-channel shunt transistor 506 low. Thus, current I_SHUNT goes to zero and current I_LED is equal to I_MASTER. This transition is highly advantageous for several reasons. First, the ANODE voltage (VA−VC) across LED 508 and n-channel drive transistor 508 is the same as in the immediately preceding cycle. Thus, there is no abrupt change is module current and no EMI. Second, even though the forward voltage VF of each module may be different, each respective module voltage and current is the same before and after the transition. Third, no settling time is required for each respective module LED and drive transistor to attain a stable forward voltage. This significantly reduces oscillation where multiple series-connected modules are employed and have inherently large inductance, capacitance, and current. Finally, the transition is highly efficient, since it occurs when MATCH goes high. No lag time is required for forward voltage VF settling in series-connected modules before LED_ON goes high.

Referring back to FIGS. 5 and 6, at time t3 SAMPLE goes high and ADC 520 acquires a new sample of ANODE terminal voltage VA. Current I_SHUNT remains low between times t2 and t4 while current I_LED is equal to current I_MASTER. At time t4, LED_ON goes low and turns off n-channel transistor 518 and n-channel drive transistor 510. This permits amplifier 500 to drive the gate of n-channel shunt transistor 506 high, and I_SHUNT increases to equal I_MASTER. SLEW_DN goes high so that OR gate 806 applies a high level enable signal to the CNT_EN terminal of counter 802 (FIGS. 8 and 9) causing CLK to oscillate. SLEW_UP applies a low level to the CNT_UP terminal of counter 802 to initiate a down count. The down count is applied to DAC 524 to cause a controlled, step-wise linear decrease in SHUNT_REF. The decrease in SHUNT_REF at the negative input of amplifier 500 causes an increase in output voltage $V_{OUT}$ at the gate of n-channel drive transistor 506. In response, n-channel shunt transistor 506 becomes more conductive. This produces a slight increase in I_SHUNT as the sum of I_MASTER and current from capacitor 512 as well as a step-wise decrease in ANODE voltage VA. Thus, VA tracks the incremental decrease of SHUNT_REF as indicated by the bold line between times t4 and t5.

At time t5, counter 802 reaches zero and SLEW_DN goes low. The low levels of SLEW_UP and SLEW_DN produce a low level output from OR gate 806 at the counter enable terminal CNT_EN, and clock signal CLK oscillation is terminated. Thus, current I_LED goes to zero and current I_SHUNT is equal to I_MASTER. This transition is highly advantageous for several reasons. First, the ANODE voltage (VA−VC) across n-channel shunt transistor 506 is the same as the previous voltage across LED 508 and n-channel drive transistor 510. Thus, there is no abrupt change is module current and no EMI. Second, the respective module forward voltage VF of each module is sampled and stored at time t3 for use in the next cycle. Third, no settling time is required for each respective module n-channel shunt transistor to attain a stable forward voltage. This significantly reduces oscillation where multiple series-connected modules are employed and have inherently large inductance, capacitance, and current. Finally, the transition is highly efficient, since it begins as soon as LED_ON goes low and ends when counter 802 reaches zero.

At time t6, current I_MASTER and current I_SHUNT go to zero. I_MASTER remains off until time t7 when a new cycle begins. Current source 100 (FIG. 1) produces current I_MASTER. LED 508 is unselected and I_LED is zero. LED_ON is low, so n-channel drive transistor 510 and n-channel transistor 518 are off. Amplifier 500 again controls the gate voltage of n-channel shunt transistor 506. ADC circuit 520 applies the digital sample of ANODE voltage VA acquired at time t3 to one set of inputs of comparator 800. Counter 802 applies a present count to another set of inputs of comparator 800. The initial count of counter 802 does not match the digital sample of ANODE voltage VA, so MATCH is initially low. At time t8, a high level of SLEW_UP initiates a positive slew rate transition of SHUNT_REF, and clock signal CLK begins to oscillate. The high level of SLEW_UP and the low level of MATCH produce a high level output from AND gate 804 and from OR gate 806. The high level from OR gate 806 is applied to the CNT_EN terminal of counter 802. The high level from SLEW_UP is applied to the CNT_UP terminal of counter 802 causing it to count up in response to clock signal CLK. DAC 524 receives the increasing count and produces a corresponding step-wise linear increase in SHUNT_REF. SHUNT_REF is applied to the negative input terminal of amplifier 500 (FIG. 5). The increase in SHUNT_REF causes a decrease in $V_{OUT}$ from amplifier 500, which is applied to the gate of n-channel transistor 506. This decrease in gate voltage produces a slight decrease in drain current I_SHUNT through n-channel transistor 506 and a corresponding step-wise linear increase in ANODE voltage VA. Thus, VA tracks the incremental increase of SHUNT_REF as indicated by the bold line between times t8 and t9.

Counter 802 continues to count up from time t8 until time t9. At time t9 both SHUNT_REF and ANODE voltage (VA−VC) have attained a high level through a controlled and step-wise linear slew rate. Also at time t9 the count from counter 802 matches the digital sample from ADC 520. Comparator 800 responsively produces a high level MATCH signal. The high level of MATCH produces a low level output from AND gate 804. Both inputs to OR gate 806 are low and produce a low input at the CNT_EN terminal of counter 802 to disable the counter. SLEW_UP remains high for short time after t9, since it is generally not known when the counter output will equal the ADC sample until MATCH goes high.

When MATCH goes high, ANODE voltage VA−VC is equal to the sampled anode voltage from a previous cycle. Responsively, LED_ON goes high to turn on LED drive transistor 510 and illuminate LED 508. Transistor 518 also turns on at substantially the same time to drive the gate of n-channel shunt transistor 506 low. Thus, current I_SHUNT goes to zero and current I_LED is equal to I_MASTER.

At time t10 SAMPLE goes high and ADC 520 acquires a new sample of ANODE voltage VA. Current I_SHUNT remains low between times t9 and t11 while current I_LED is equal to current I_MASTER. At time t11, LED_ON goes low and turns off n-channel transistor 518 and n-channel drive transistor 510. This permits amplifier 500 to drive the gate of n-channel shunt transistor 506 high, and I_SHUNT increases to equal I_MASTER. SLEW_DN goes high so that OR gate 806 applies a high level enable signal to the CNT_EN terminal of counter 802 causing CLK to oscillate. SLEW_UP applies a low level to the CNT_UP terminal of counter 802 to initiate a down count. The down count is applied to DAC 524 to cause a controlled, step-wise linear decrease in SHUNT_REF. The decrease in SHUNT_REF at the negative input of amplifier 500 causes an increase in output voltage $V_{OUT}$ at the gate of n-channel drive transistor 506. In response, n-channel shunt transistor 506 becomes more conductive. This produces a slight increase in I_SHUNT as the sum of I_MASTER and current from capacitor 512 as well as a step-wise decrease in ANODE voltage VA−VC. Thus, VA tracks the incremental decrease of SHUNT_REF as indicated by the bold line between times t11 and t12.

At time t12, counter 802 reaches zero and SLEW_DN goes low. The low levels of SLEW_UP and SLEW_DN produce a low level output from OR gate 806 at the counter enable terminal CNT_EN, and clock signal CLK oscillation is terminated. Thus, current I_LED goes to zero and current I_SHUNT is equal to I_MASTER. At time t13, current I_MASTER turns off and I_SHUNT goes to zero. I_MASTER remains off until a new cycle begins.

There are several significant advantages of the present invention over the prior art. Precise slew rate control permits a very high dynamic range and linearity of LED dimming. Dimming is precisely controlled with digital timing, which has a very high resolution. Current through the LED begins almost instantly with a high level of LED_ON and ends almost instantly with a low level of LED_ON. Minimum current pulse duration through the LED, therefore, may be exceptionally short with fast edges. This avoids linearity errors inherent with slow rise and fall times. Even with fast edge transitions of the present invention, however, voltage across the module does not change. Moreover, current through the module does not change with transitions between illuminated and dimmed states, so EMI is well controlled.

Still further, while numerous examples have thus been provided, one skilled in the art should recognize that various modifications, substitutions, or alterations may be made to the described embodiments while still falling within the inventive scope as defined by the following claims. For example, although embodiments of the present invention utilize a digital counter to control slew rate, one of ordinary skill in the art having access to the instant specification will appreciate that various analog circuits may be used in lieu of their digital equivalents. For example, a ramp generator having current sources to charge and discharge a capacitor may replace digital counter 802 and DAC 524. A capacitor may be used to store a sample of ANODE voltage VA in lieu of ADC circuit 520. An analog comparator may be used to compare the analog sample voltage to the ramp generator voltage. Moreover, although metal oxide semiconductor (MOS) transistors are disclosed in various embodiments of the present invention, one of ordinary skill in the art will appreciate that bipolar transistors, junction field effect transistors, or other switching devices may be used. Other combinations will be readily apparent to one of ordinary skill in the art having access to the instant specification.

What is claimed is:

1. A light system, comprising:

a current source;

a plurality light emitting diode (LED) modules connected in series, having a first end coupled to the current source by a single wire, and having a second end coupled to a supply voltage terminal, each module having a slew rate control circuit to control voltage across the respective module, wherein the slew rate control circuit comprises:

a sample circuit to acquire a respective module sample voltage;

a ramp generator circuit to produce a ramp voltage; and a comparator circuit to produce a match signal when the ramp voltage matches the respective module sample voltage; and a control circuit arranged to control the current source.

2. The system of claim 1, wherein the control circuit is arranged to communicate with the LED modules over the single wire by amplitude shift keying.

3. The system of claim 1, wherein the control circuit is arranged to communicate with the LED modules over the single wire by frequency shift keying.

4. The system of claim 1, wherein each module of the plurality of modules is individually addressable by the control circuit.

5. The system of claim 1, wherein the sample circuit comprises an analog-to-digital converter.

6. The system of claim 1, wherein the ramp generator circuit comprises a digital counter; and a digital-to-analog converter.

7. The system of claim 1, wherein the ramp voltage is a step-wise linear ramp voltage.

8. The system of claim 1, wherein the comparator circuit is a digital comparator circuit.

9. A method of operating a light system, comprising:

conducting a current through a light emitting diode (LED) at a first time;

sampling a first voltage at the LED at the first time;

removing the current from the LED at a second time after the first time, wherein the step of removing the current from the LED at a second time comprises shunting the current through a shunt transistor;

increasing a forward voltage at the LED at a third time after the second time until the forward voltage matches the first voltage; and conducting a current through the LED at a fourth time in response to the step of matching.

10. The method of claim 9, wherein the step of conducting a current through a LED at a first time comprises turning on a drive transistor connected in series with the LED.

11. The method of claim 9, comprising sampling the first voltage with an analog-to-digital converter (ADC).

12. The method of claim 9, wherein the step of removing the current from the LED at a second time comprises turning off a drive transistor connected in series with the LED.

13. The method of claim 9, wherein the step of increasing the forward voltage comprises generating a ramp voltage.

14. The method of claim 9, wherein the step of increasing the forward voltage comprises:

incrementing a digital counter to produce an increasing digital count; and converting the digital count to an analog voltage with a digital-to-analog converter.

15. The method of claim 9, comprising:

removing the current from the LED at a fifth time after the fourth time;

decrementing a digital counter to produce a decreasing digital count; and converting the digital count to an analog voltage with a digital-to-analog converter.

16. A light system, comprising:

a light emitting diode (LED);

a drive transistor having a current path connected in series with the LED;

a shunt transistor having a current path connected to the LED;

a ramp generator circuit;

an amplifier having a first input terminal connected to the LED, a second input terminal connected to the ramp generator circuit, and an output terminal connected to a control terminal of the shunt transistor.

17. The system of claim 16, wherein the ramp generator circuit comprises:

a counter circuit to produce a digital count; and a digital-to-analog converter to produce a ramp voltage from the digital count.

18. A controller for a light system, comprising:

a drive transistor having a current path couplable in series with a LED;

a shunt transistor having a parallel current path couplable to the LED;

a ramp generator circuit;

an amplifier having a first input terminal couplable to the LED, a second input terminal coupled to the ramp generator circuit, and an output terminal couplable to a control terminal of the shunt transistor.

* * * * *